US007066220B1

(12) United States Patent
Take et al.

(10) Patent No.: US 7,066,220 B1
(45) Date of Patent: Jun. 27, 2006

(54) YARD WASTE COLLECTION SYSTEM

(75) Inventors: Rafael C. Take, Wildwood, MO (US); Randall H. Johnson, Ballwin, MO (US)

(73) Assignee: Take and Associates, Inc., Ballwin, MO (US)

( * ) Notice: Subject to any disclaimer, the term of this patent is extended or adjusted under 35 U.S.C. 154(b) by 0 days.

(21) Appl. No.: 11/292,642

(22) Filed: Dec. 2, 2005

Related U.S. Application Data

(60) Provisional application No. 60/633,203, filed on Dec. 6, 2004.

(51) Int. Cl.
*B65B 1/04* (2006.01)

(52) U.S. Cl. ..... 141/391; 141/315; 141/316

(58) Field of Classification Search ..... 141/10, 141/315–316, 391; 248/97–101
See application file for complete search history.

(56) References Cited

U.S. PATENT DOCUMENTS

| | | | | |
|---|---|---|---|---|
| 3,934,803 | A | 1/1976 | Paulus, Jr. | |
| 4,037,778 | A | 7/1977 | Boyle | |
| 4,832,292 | A | 5/1989 | Beckham | |
| 5,106,041 | A | 4/1992 | Jelincic | |
| 5,107,666 | A | 4/1992 | Rahtican | |
| 5,129,609 | A | 7/1992 | Tobin | |
| 5,222,536 | A * | 6/1993 | Hodgdon et al. | 141/390 |
| 5,292,093 | A | 3/1994 | Shumake | |
| 6,511,026 | B1 * | 1/2003 | Hatfield | 248/97 |
| 6,896,015 | B1 * | 5/2005 | Beveridge | 141/314 |
| 2004/0026578 | A1 | 2/2004 | King et al. | |

* cited by examiner

*Primary Examiner*—Steven O. Douglas

(57) ABSTRACT

A novel yard waste collection system is provided which can be used with both paper and plastic trash and lawn waste bags. A pair of upside down U-shaped members are provided which are connected by four pivoted arms to create a support frame such that the support frame can be held in either an open or closed position. The open end of the U-shaped members faces towards the ground with the closed end of the U-shaped members being on the top side of the support frame when in use. When the support frame is in closed position, the device is relatively flat for easy storage in a closet, garage, or storage shed. The four pivoted arms, two on each side of the pair of U-shaped members, are pivotally connected to the two U-shaped members such that a first U-shaped member is held below the second U-shaped member. The device can be pivoted to an open position such that the two U-shaped arms remain in a generally parallel position in respect to one another forming a rectangular box shape. At this point the two U-shaped members are now at the same height with respect to one another and held apart the appropriate distance equal to the length of the pivoted arms to support either the paper or plastic yard waste bag being used.

20 Claims, 5 Drawing Sheets

YARD WASTE COLLECTION SYSTEM

CROSS-REFERENCE TO RELATED APPLICATIONS

This application claims the benefits of provisional application Ser. No. 60/633,203 filed Dec. 6, 2004 in the United States Patent and Trademark Office.

FIELD OF THE INVENTION

The present invention relates generally to the field of trash and lawn bag holders and more particularly to a new yard waste collection system for use with either paper or plastic trash or lawn waste bags. When the yard waste collection device is used with paper lawn waste bags, the device facilitates the opening of such bags. The yard waste collection system further aids in the insertion of trash or lawn debris into the yard waste bag attached thereto.

BACKGROUND OF THE INVENTION

Yard waste removal has long been an endless weekend task completed by homeowners all over the world. In many municipalities, yard waste, such as leaves and grass clippings, is considered to be recyclable material and is therefore directed to compost facilities. These municipalities will dispose of yard waste separately than normal trash for recycling. As such, the yard waste is typically required to be stored in special waste collection bags for pickup. However, other municipalities only require the use of plastic bags for holding this yard waste. Hardware, grocery and convenience stores generally sell either paper or plastic yard waste collection bags that are compliant with the regulations governing such disposal and recycling of yard waste. When using these yard waste collection bags, several problems and annoyances are obvious. The paper bags are difficult to initially open and to then hold open while filling, and plastic bags are difficult to hold open in a supported position so as to allow for easy insertion of the yard or garbage waste.

There are many existing apparatuses for aiding in the use of waste collection bags. The prior art devices generally fall into two categories; the first is a group of devices used to ease opening of either paper or plastic bags and consequently aiding in holding them open. U.S. Pat. No. 6,155,522 discloses a yard debris collecting system utilizing a pivoted frame, a chute couplable to the frame and a collection bag couplable to the frame such the chute extends into and opens into the open bag. However, the frame of the '522 patent would prevent easy removal of the frame from the interior of the bag when the bag is full of trash or yard waste. The frame is further provided with bent feet, which would also prevent the easy removal of the device from inside the bag. U.S. Pat. Nos. 5,292,093; 5,129,609; and 4,037,778, and Publication No. U.S. 2004/0026578 all show the use of accordion style cardboard or hard plastic inserts which can be placed into either paper or plastic waste collection bags and then be unfolded to assist in opening the bags. The inserts are sufficiently rigid to hold the waste collection bags upright for easy filling. For example, the bag insert of the King et al. Publication set forth above describes an accordian style insert which can be inserted into a paper yard waste bag to expand the bag and maintain it in an upright and open position. The yard waste can now be inserted into the bag by dropping the waste through the open top of the bag insert. After waste collection is complete, the bag insert is capable of being folded along several axes such that the size of the bag insert is reduced for storage. The other three issued patents listed above all show similar expandable inserts for use with plastic yard or garbage waste bags which can be unfolded to expand the plastic bag and hold the bag in the open position for filling with yard waste or garbage waste. When removed from the bag, the inserts can be folded up for storage.

The second group of patents relate to devices that hold one end of a plastic yard waste bag open such that the bag can be placed on its side in an open position to allow for filling with yard waste. U.S. Pat. Nos. 5,107,666; 5,106,041; 4,832,292; and 3,934,803 all show devices which can be used in this fashion. For example, the Paulus, Jr. reference (U.S. Pat. No. 3,934,803) shows a bag supporting device for holding a plastic yard waste bag with its receiving end in an open position essentially perpendicular to a horizontal surface to permit leaves and trash to be raked or swept into the interior of the bag. In some cases these devices are provided with integral scoops to allow for easy access to the bag.

While these devices may fulfill their respective, particular objectives and requirements, the above mentioned patents do not disclose a new yard waste collection system that can be used with both paper and plastic yard waste bags and which facilitates the opening of such bags. The system further includes a top which functions both as a top and a chute to facilitate the loading of debris into the bag held within the device. A second top and side panels can be used to create a four-sided chute to further ease the loading of debris into the bag. Additionally, a novel plastic bag clip mechanism is provided which easily secures the plastic bag against the frame of the yard waste collection device.

SUMMARY OF THE INVENTION

In accordance with the present invention, a novel yard waste collection system is provided which can be used with both paper and plastic trash and lawn waste bags. A pair of upside down U-shaped members are provided which are connected by four pivoted arms to create a support frame such that the support frame can be held in either an open or closed position. The open end of the U-shaped members faces towards the ground with the closed end of the U-shaped members being on the top side of the support frame when in use. When the support frame is in closed position, the device is relatively flat for easy storage in a closet, garage, or storage shed. The four pivoted arms, two on each side of the pair of U-shaped members, are pivotally connected to the two U-shaped members such that a first U-shaped member is held below the second U-shaped member. The device can be pivoted to an open position such that the two U-shaped arms remain in a generally parallel position in respect to one another forming a rectangular box shape. At this point the two U-shaped members are now at the same height with respect to one another and held apart the appropriate distance equal to the length of the pivoted arms to support either the paper or plastic yard waste bag being used.

The yard waste collection device is used differently when used with either the recyclable paper yard waste bag or the plastic trash or yard waste bags. With the paper yard waste bags, the paper bag is first unfolded and provisionally opened by the user. The bag support device is inserted into the paper bag in the folded or closed position until the first one of the U-shaped members is resting on the bottom of the bag. In some situations in may be easier to insert the folded support device into the partially open paper bag in a diagonal fashion with respect to the opening of the paper bag. The bag support device is then unfolded to lower the second U-shaped member with respect to the first U-shaped member. The two U-shaped members are connected by the four pivoted arms, two on each side of the U-shaped members, to allow the second U-shaped member to move downwardly with respect to the first U-shaped member in a generally parallel fashion. By lowering the second U-shaped member with respect to the first U-shaped member while the support device is inside the paper bag, the paper bag is now fully extended or opened by the support device such that the bag opening is in form of a rectangle or square and the sides of the paper bag are held tight against the support device in the fully extended and opened position. If desired, a lid or top can now be snapped into place over the two top support sides of the two U-shaped members to allow closure of the waste container. Furthermore, the lid can act as a scoop when the bag support device is upright or if the bag support device is placed on its side with the top laying flat on the ground to assist in placing trash or yard waste into the paper bag. When the bag is full, it is a simple matter to grab the top of the two U-shaped members and to pull upwards until the four freestanding ends of the U-shaped members are removed from the interior of the bag. The paper waste bag can now be closed and placed near the street for removal by the appropriate garbage service.

When the bag support device of the present invention is used with a plastic bag, the device is used somewhat differently than described above. An appropriate sized trash or yard waste plastic bag is placed inside the support frame when the frame is in the open position. A clip mechanism is provided on each U-shaped member which can moved from an unlocked to a locked position about the plastic bag locking the plastic bag to the top frame of the bag support device. Refuse or yard waste can now be placed within the opening of the plastic bag. Additionally, a lid or top can also be attached to the top of the support frame to ease insertion of yard waste into the bag. The support frame can also be placed on its side to allow the top to rest on the ground to assist in scooping debris or yard waste into the plastic bag.

Accordingly, it is a primary object of the invention to provide a novel yard waste collection system that can be used with either paper or plastic yard waste bags.

A further object of the invention is to provide a yard waste support device that can be easily folded up for easy storage in a closet, garage or storage shed.

A further object of the invention is to provide a yard waste support device that will assist in opening a paper yard waste bag when inserting the device into the bag in a closed or folded position and then unfolding the support device which acts to further open the paper bag until it is in a fully open position.

A further object of the invention is to provide a yard waste support device that can be easily removed from the interior of paper yard waste bag without grabbing or pulling any of the yard waste out from the interior of the bag.

A still further object of the invention is to provide a yard waste collection system having an add on top which acts as both a lid and a scoop to assist in adding debris or yard waste into the bag.

These together with other objects of the invention, along with the various features of novelty that characterize the invention, are pointed out with particularity in the claims attached hereto and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
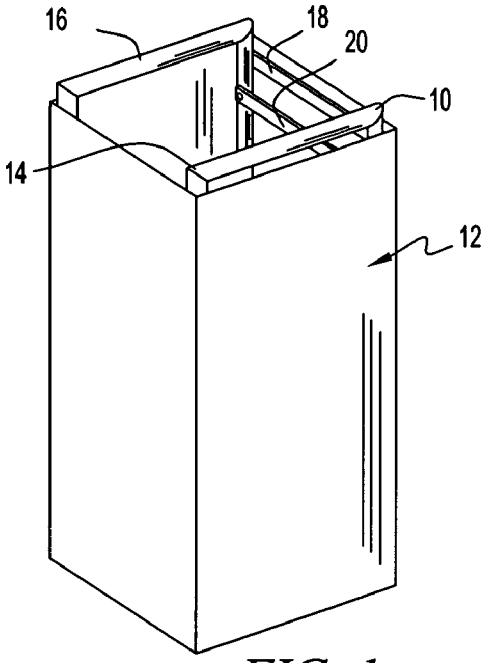
FIG. 1 illustrates the preferred embodiment of the present invention having been unfolded within a paper yard waste collection bag.

With reference to the drawings, and in particular to FIGS. 1 through 14 thereof, a new yard waste collection system embodying the principles and concepts of the present invention and generally designated by the reference numeral 10 will be described.

Figure 2:
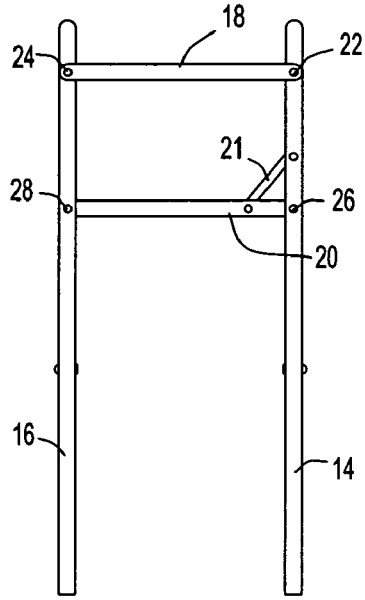
FIG. 2 illustrates a side view of the preferred embodiment of the present invention showing the support frame in the unfolded upright position.

Referring now to FIG. 1, the yard waste collection system 10 is shown unfolded and inserted inside a typical paper yard waste bag 12. As can be seen in FIG. 1, the paper bag is shown in a fully expanded condition with the sides shown taught against the frame of the yard waste collection system providing the largest opening position for the paper bag to allow for the easy insertion of yard waste into the bag. The yard bag support frame is shown having a first upside down U-shaped member 14 and a second upside down U-shaped member 16. The first and second U-shaped members 14 and 16 are connected to one another by a pair of upper arms 18 (identical, only one upper arm is shown in FIG. 1) and a pair of lower arms 20 (identical, only one lower arm is shown in FIG. 1). Referring now to FIG. 2, a side view of the system 10 is shown with the respective U-shaped members 14 and 16 being separated by upper arm 18 and lower arm 20.

Upper arm 18 is pivotally connected to first U-shaped member 14 at 22 and pivotally connected to second U-shaped member 16 at 24. Lower arm 20 is pivotally connected to first U-shaped member 14 at 26, and pivotally connected to second U-shaped member 16 at 28. A short support arm 21 is pivotally connected between U-shaped member 14 and lower arm 20 to provide additional support to the overall frame of the device. The lower arms 20 and upper arms 18 are pivotally connected to each side of the two U-shaped members in the same fashion so only one side will be described here. However, on the other sides of the respective first and second U-shaped members 14 and 16 the arms are connected in the same manner.

Figure 3:
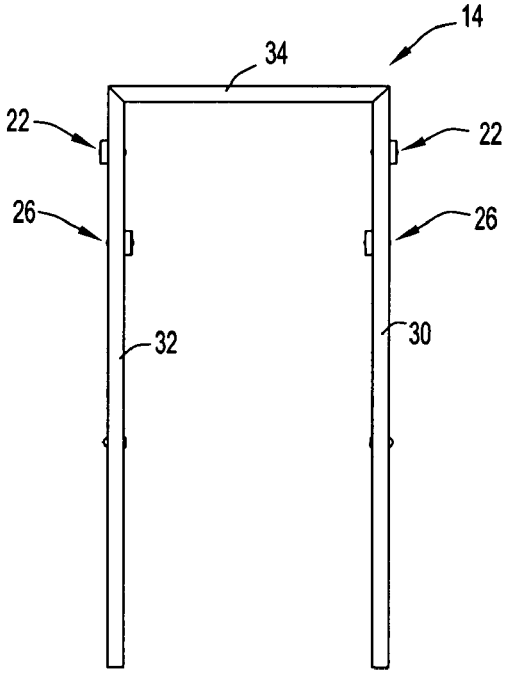
FIG. 3 illustrates a front view of the preferred embodiment of the present invention showing the support frame in the unfolded upright position.
Figure 4:
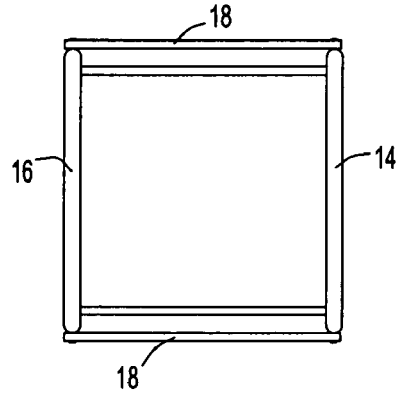
FIG. 4 illustrates a top view of the preferred embodiment of the present invention shown in the unfolded position.

Referring now to FIG. 3, a front view of the support device is shown wherein the first U-shaped member 14 is shown in plan view. The first U-shaped member 14 is shown having two downwardly depending legs 30 and 32 and cross brace 34. Likewise, now referring to FIG. 6, the second U-shaped member 16 is shown having two downwardly depending legs 36 and 38 and cross brace 40. And, referring to FIG. 4, a top view of the support device 10 is shown in the open or unfolded position showing first U-shaped member 14 and second U-shaped member 16 separated by the two upper arms 18.

All of the various components of the present invention can be made of PVC material or thin metal tubing. Preferably, the support frame, including the legs and cross braces are made of PVC piping or thin metal tubing. The arms will be made of either thin stamped metal or injection molded plastic. The arms are pivotally connected to the U-shaped members with rivets or nuts and bolts or in any other manner that is typically known to connect two parts while allowing movement between such two parts. Furthermore, downwardly depending legs 30, 32, 36, and 38 can be made up of two pieces that are interconnected at approximately their halfway point so that the bag support device can be taken apart for easy shipping and/or storage.

Figure 5:
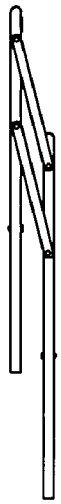
FIG. 5 illustrates a side view of the present invention shown in a folded position.
Figure 6:
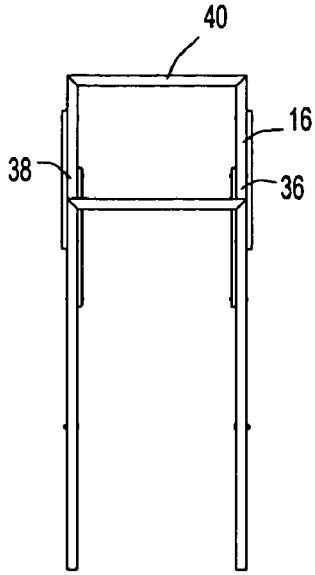
FIG. 6 illustrates a front view of the present invention shown in a folded position.
Figure 7:
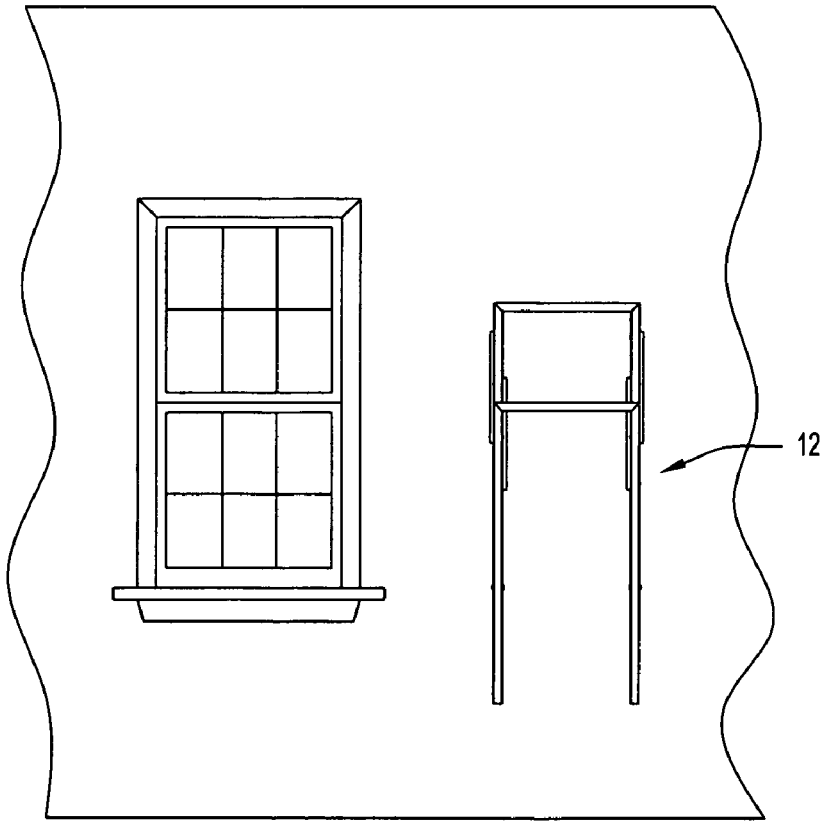
FIG. 7 illustrates the preferred embodiment of the present invention shown in a folded position hanging on the wall in a garage or storage shed.

FIGS. 5 and 6 show the yard waste collection system in the folded or closed position. The second U-shaped member 16 is folded up towards the first U-shaped member 14 such that the second member remains parallel to the first member at all times. Since the two U-shaped members are pivotally connected at four points, the two U-shaped members remain parallel to each other in both the open and folded positions and at all positions therebetween. This is an important feature to the invention and enables the yard waste support frame to assist in opening the paper bags during installation of the support frame into the bag. This will be described in greater detail below. FIG. 7 shows the folded yard waste bag support 12 in the folded position hanging on the wall of a garage or storage shed.

Figure 8:
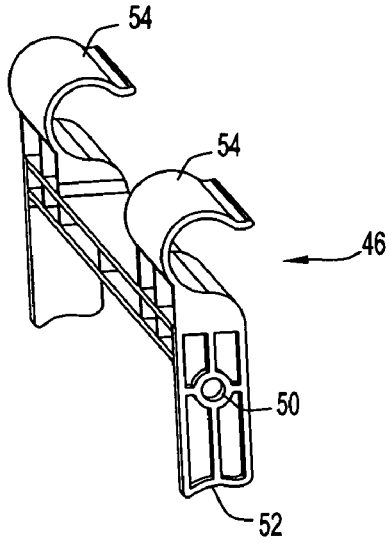
FIG. 8 illustrates perspective view of the plastic bag clip shown not attached to the present invention.
Figure 9:
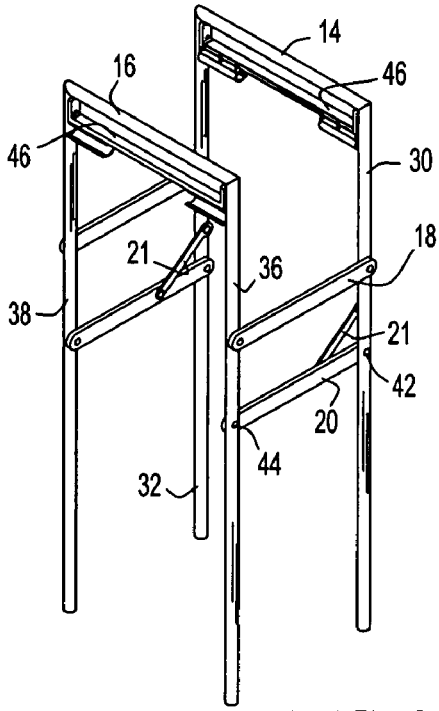
FIG. 9 illustrates a perspective view of the present invention shown in an unfolded position with no waste bags clearly depicting the plastic bag clip mechanisms.

FIG. 9 show the bag support device in its unfolded upright position without any bags installed on the frame. The lower arm 20 is shown in its unfolded position and a short support arm 21 is provided which is pivotally connected between the leg of U-shaped member 14 and the lower arm 20 at assist in locking the frame in its open and locked position. Support arm 21 also prevents the frame from moving past its fully open position shown in FIG. 9 where U-shaped member 16 would be lower than U-shaped member 14. However, support arm 21 will not prevent the second U-shaped member 16 from being able to move up and towards the first U-shaped member 14 when folding the support frame together for storage. A pair of plastic bag locking clips 46 are shown attached to the U-shaped members 14 and 16. Each clip 46 is rotatably connected between the downwardly depending legs 30 and 32 of member 14 and legs 36 and 38 of member 16. Referring to FIG. 8, clip 46 includes a pair of holes 50 for receiving a rivet or bolt to rotationally fixing the clip to the members 14 and 16. Clip 46 is further provided with an arcuate portion 52 which as shown in FIG. 9 provisionally locks the clips in a non bag attaching position with respect to the frame. The clip is also provided with a clip member 54 with can be pivoted into position to clamp a plastic bag about the respective cross braces 34 and 40 of U-shaped members 14 and 16, respectively, as shown in FIG. 12.

Figure 10:
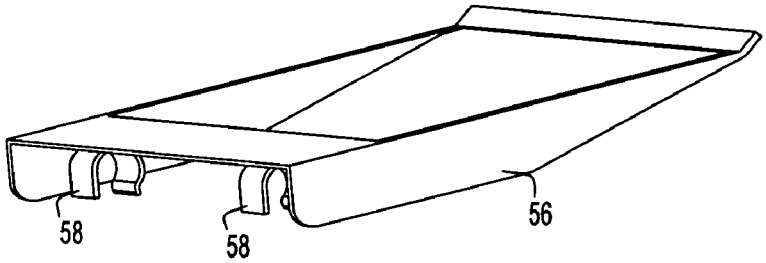
FIG. 10 illustrates a perspective view of the top or lid for the yard waste collection system.
Figure 11:
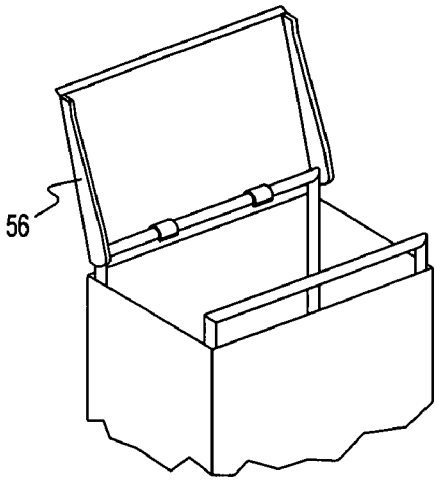
FIG. 11 illustrates a perspective view of the top lid attached to the U-shaped member of the support frame of the present invention.

Referring to FIGS. 10 and 11, a lid 56 is shown in greater detail. The lid 56 is shown having a pair of clips 58 for snapping the lid in place about either of the cross braces 34 and 40 of members 14 and 16. The clips 58 are positioned closer to the centerline of the lid so that when the lid is snapped in place on the cross brace it will not interfere with the plastic bag locking clips 46 that will be pivoted into position to lock and unlock a plastic bag to the bag support device of the present invention. The lid 56 will preferably be made of injection molded malleable plastic.

Figure 12:
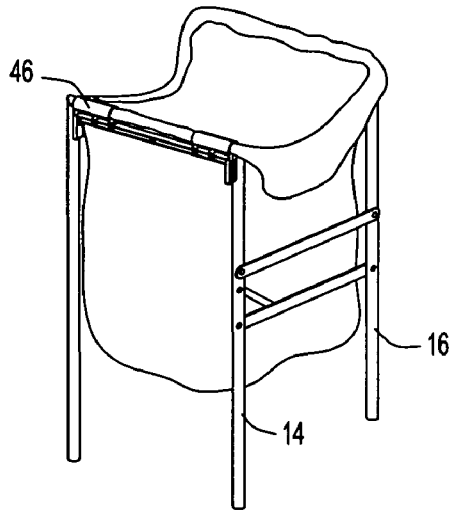
FIG. 12 illustrates the support frame of the present invention supporting a plastic bag.

FIG. 12 shows the support frame 10 supporting a plastic bag within its frame. The plastic bag is held in place within the support frame by rotating the plastic bag locking clip 46 into position such that the clip members 56 affix the plastic bag to the cross braces 34 and 40 of the bag support device. The clip members 56 can be easily unsnapped from about the cross brace so that the plastic bag can be removed from within the support frame.

Figure 14:
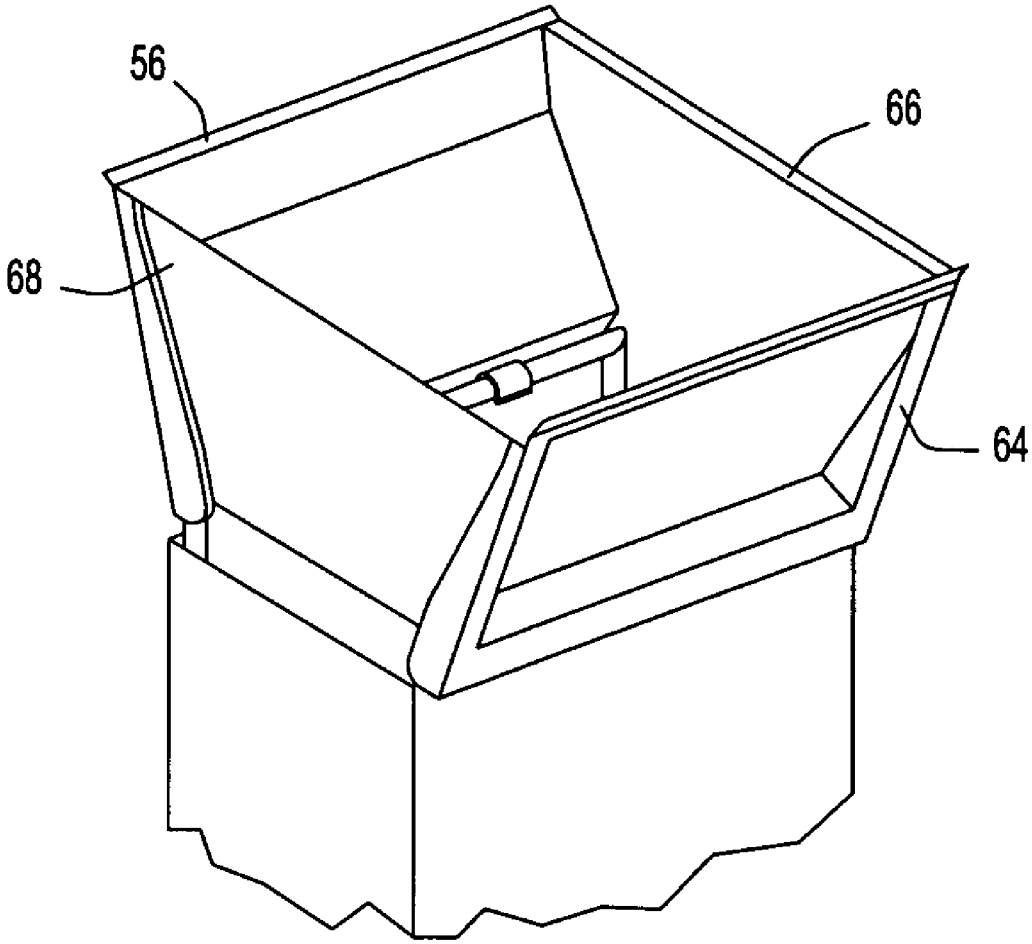
FIG. 14 illustrates an alternate embodiment of the invention with two lids and side panels being used to create a chute.

FIG. 14 shows an alternate embodiment of the present invention by adding a second lid 64 to the other cross brace of the support frame. A pair of side panels 66 and 68 can be added so as to be positioned between the two lids to create a chute to allow debris to be easily added to the waste bag. With the chute in place, you can also lay the device on its side with one of the side panels touching the ground. This also allows yard waste to be easily scooped into the yard waste collection bag.

OPERATION OF THE PREFERRED EMBODIMENT

Figure 13:
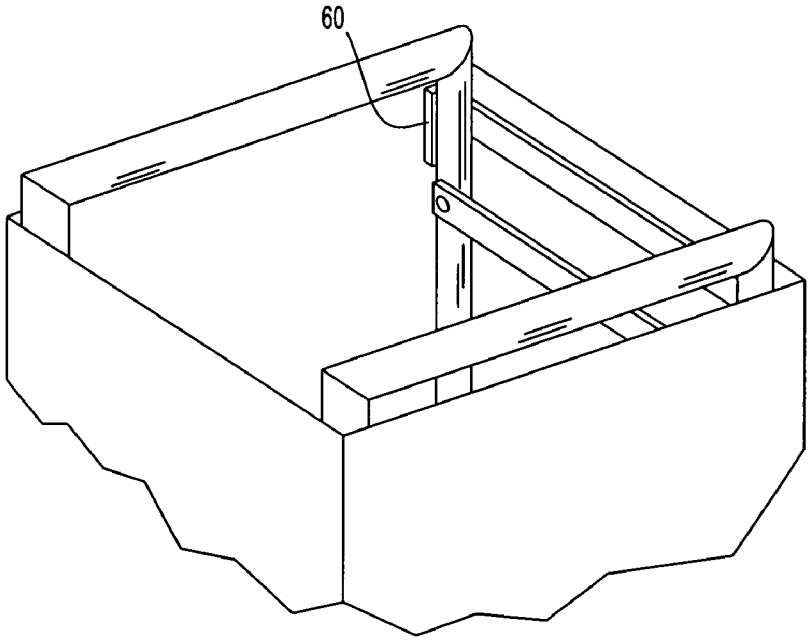
FIG. 13 illustrates the support frame of the present invention supporting a paper bag with the foam pads in contact with the paper bag.

In operation the yard waste collection system is used in the following manner. When used with a paper yard waste bag, the bag 12 would first be unfolded by the user and partially opened. The paper bag support frame 10 would be inserted into the paper bag with the support frame 10 in the closed or folded position. Once the two legs 30 and 32 of the first U-shaped member 14 reach the bottom of the paper bag, the second U-shaped member 16 is released and unfolded from the folded position into the unfolded or open position as shown in FIG. 1. It has been found that it is easier to insert the folded support frame 10 into the paper bag in a diagonal manner such that when the support frame is unfolded, the paper bag and support frame square up such that the paper bag is stretched tightly between the respective legs of the first and second U-shaped members as shown in FIG. 1. The ease of use of the support frame of the present invention is due primarily because of the unique way in which the first U-shaped member 14 and second U-shaped member 16 are connected to each other. Since the two members are connected via two upper arms 18 and lower arms 20 at four pivot points 22, 24, 26 and 28, the first and second U-shaped members are kept generally parallel to each other at all times during the unfolding process. As can be seen in FIG. 13, a pair of foam pads 60 are provided on the upper portion of the legs 30 and 32 of the first U-shaped member 14 near the adjacent pivot points 22. These foam pads act as very soft springs which assist in holding the upper edge of the paper bag tight against the support frame.

The user may then attach the lid 56 to the top of one of the cross braces to close the top of the paper bag or otherwise keep the unsightly waste material in the bag hidden from sight. Furthermore, if the user wishes to use the lid 56 as a scoop, the support frame 10 with paper bag 12 installed there about can be placed on its side with the lid 56 flat on the ground. Yard waste or other debris can now be sweep into the paper bag with the lid acting as a scoop to assist in guiding the material into the paper bag. When the paper bag is full of waste material or other debris, the support frame 10 is simply grasped by the user by cross braces 34 and 40 and pulled upwardly out of the paper bag. Since the support frame 10 has substantially only four straight leg members extending into the inside of the paper bag, this means that there is very little surface area in contact with the debris inside the paper bag. Because of this, the support frame can be removed from the bag with ease, without pulling any of the yard waste or other debris out of the paper bag.

Furthermore, when the yard waste collection bag support frame 10 is being used with the side panels to form a chute as shown in FIG. 14, the support frame 10 can be laid on its side with a side panel being placed flat on the ground to receive any yard waste on the ground. In some situations it may be easier to lay the side panel flat on the ground than the lid portion.

When the yard waste collection bag support frame 10 is used with a plastic bag, the frame is first opened and set on the ground. A plastic bag in then placed inside the frame with the top of the plastic bag folded over the two cross braces 34 and 40 of the first and second U-shaped members 14 and 16, respectively. The clips 46 are then rotated into position such that the clip members 54 are snapped or clipped over the cross braces pinning the plastic bag between the clip members of the clips 46 and the cross braces to securely hold the plastic bag to the support frame. When the bag is full, the clip members 54 are rotated out of its locked position about the cross brace, and the bag support frame can be easily pulled upwardly from about the plastic bag which would remain sitting on the ground. The plastic bag can then be tied closed and removed to the curb for disposal. The yard waste collection bag support frame with the plastic bag can also be laid on its side with either the lid or a side panel laid flat on the ground to receive yard waste as desired by the user.

Numerous modifications and adaptations of the present invention will be apparent to those skilled in the art and thus, it is intended by the following claims to cover all such modifications and adaptations which fall within the true spirit and scope of the invention.

What is claimed is:

1. A yard waste collection system, comprising:

a frame, said frame having a pair of U-shaped members and a pair of upper arms and a pair of lower arms, said upper pair of arms having first ends pivotally connected to the first U-shaped member and second ends pivotally connected to the second U-shaped member, said lower pair of arms having first ends pivotally connected to the first U-shaped member and second ends pivotally connected to the second U-shaped member, such that the second U-shaped member is allowed to move upwardly and towards the first U-shaped member so that the first and second U-shaped members remain substantially parallel to each other while in both an unfolded and folded position, and in all positions therebetween;

said frame being couplable with a collection bag for supporting the bag in an open condition to receive yard waste therein.

2. A yard waste collection system of claim 1, further comprising a lid being connected to the top of one of the U-shaped members, the top being movable between an open and a closed position with respect to the bag being supported by said frame.

3. A yard waste collection system of claim 1, further comprising said frame being movable from an unfolded position to a folded position to decrease the width of the yard waste collection system to allow such system to be hung on the wall of a garage or other storage area.

4. A yard waste collection system of claim 3 for use with paper yard waste collection bags, said frame being insertable into a partially open paper yard waste collection bag in a folded position, the frame being movable from the folded position into the unfolded position to fully open the paper yard waste collection bag for receiving yard waste therein, and including a pair of foam pads attached to the outer frame of one of the U-shaped members to assist in holding the top of the paper yard waste collection bag tightly against the frame when the frame is in the unfolded position.

5. A yard waste collection system of claim 1 for use with plastic yard waste collection bags, further comprising a clip member rotatably connected to the U-shaped member which can be moved from a first locked position to a second locked position, a plastic yard waste collection bag being insertable into the frame when the frame is in the unfolded position, the plastic yard waste collection bag being secured to the frame by rotatably moving the clip member from the first position to the second position a affix the plastic yard waste collection bag to the top of one of the U-shaped members.

6. A yard waste collection system of claim 2, wherein the frame can be placed on its side so that the lid can be opened such that the lid is flat on the ground to allow yard waste to be easily scooped into the yard waste collection bag.

7. A yard waste collection system of claim 2, further comprising:

a second lid being connected to the top of the other U-shaped member such that is is opposite the first lid, and a pair of side panels positioned between the first and second lids to provide a chute to channel yard waste into the yard waste collection bag held by the frame of the yard waste support system.

8. A yard waste collection system, comprising:

a frame, said frame having a pair of U-shaped members, a pair of upper arms, and a pair of lower arms, said upper pair of arms having first ends pivotally connected to the first U-shaped member and second ends pivotally connected to the second U-shaped member, said lower pair of arms having first ends pivotally connected to the first U-shaped member and second ends pivotally connected to the second U-shaped member, such that the second U-shaped member is allowed to move upwardly and towards the first U-shaped member so that the first and second U-shaped members remain substantially parallel to each other while in both an unfolded and folded position, and in all positions therebetween;

a support arm pivotally connected between a leg of the first U-shaped member and the lower arm to prevent the movement of the second U-shaped member past the point where the upper and lower pair of arms are perpendicular to the first U-shaped member;

said frame being couplable with a collection bag for supporting the bag in an open condition to receive yard waste therein.

9. A yard waste collection system of claim 8, further comprising a lid being connected to the top of one of the U-shaped members, the top being movable between an open and a closed position with respect to the bag being supported by said frame.

10. A yard waste collection system of claim 8, further comprising said frame being movable from an unfolded position to a folded position to decrease the width of the yard waste collection system to allow such system to be hung on the wall of a garage or other storage area.

11. A yard waste collection system of claim 8 for use with paper yard waste collection bags, said frame being insertable into a partially open paper yard waste collection bag in a folded position, the frame being movable from the folded position into the unfolded position to fully open the paper yard waste collection bag for receiving yard waste therein.

12. A yard waste collection system of claim 8 for use with plastic yard waste collection bags, further comprising a clip member rotatably connected to the U-shaped member which can be moved from a first locked position to a second locked position, a plastic yard waste collection bag being insertable into the frame when the frame is in the unfolded position, a portion of the plastic yard waste collection bag extending over the top of the U-shaped member, the plastic yard waste collection bag being secured to the frame by rotatably moving the clip member from the first position to the second position a affix the plastic yard waste collection bag to the top of one of the U-shaped members.

13. A yard waste collection system of claim 9, wherein the frame can be placed on its side so that the lid can be opened such that the lid is flat on the ground to allow yard waste to be easily scooped into the yard waste collection bag.

14. A yard waste collection system of claim 9, further comprising:

a second lid being connected to the top of the other U-shaped member such that is is opposite the first lid, and a pair of side panels positioned between the first and second lids to provide a chute to channel yard waste into the yard waste collection bag held by the frame of the yard waste support system.

15. A yard waste collection system, comprising:

a frame, said frame having a pair of U-shaped members and a pair of upper arms and a pair of lower arms, said upper pair of arms having first ends pivotally connected to the first U-shaped member and second ends pivotally connected to the second U-shaped member, said lower pair of arms having first ends pivotally connected to the first U-shaped member and second ends pivotally connected to the second U-shaped member, such that the second U-shaped member is allowed to move upwardly and towards the first U-shaped member so that the first and second U-shaped members remain substantially parallel to each other while in both an unfolded and folded position, and in all positions therebetween; and a lid being connected to the top of one of the U-shaped members, the top being movable between an open and a closed position;+ said frame being couplable with a collection bag for supporting the bag in an open condition to receive yard waste therein.

16. A yard waste collection system of claim 1, further comprising said frame being movable from an unfolded position to a folded position to decrease the width of the yard waste collection system to allow such system to be hung on the wall of a garage or other storage area.

17. A yard waste collection system of claim 15 for use with paper yard waste collection bags, said frame being insertable into a partially open paper yard waste collection bag in a folded position, the frame being movable from the folded position into the unfolded position to fully open the paper yard waste collection bag for receiving yard waste therein, and further comprising a pair of foam pads attached to the outer frame of one of the U-shaped members to assist in holding the top of the paper yard waste collection bag tightly against the frame when the frame is in the unfolded position.

18. A yard waste collection system of claim 15 for use with plastic yard waste collection bags, further comprising a clip member rotatably connected to the U-shaped member which can be moved from a first locked position to a second locked position, a plastic yard waste collection bag being insertable into the frame when the frame is in the unfolded position, the plastic yard waste collection bag being secured to the frame by rotatably moving the clip member from the first position to the second position to attach the plastic yard waste collection bag to the top of one of the U-shaped members.

19. A yard waste collection system of claim 15, wherein the frame can be placed on its side so that the lid can be opened such that the lid is flat on the ground to allow yard waste to be easily scooped into the yard waste collection bag.

20. A yard waste collection system of claim 15, further comprising:

a second lid being connected to the top of the other U-shaped member such that is is opposite the first lid, and a pair of side panels positioned between the first and second lids to provide a chute to channel yard waste into the yard waste collection bag held by the frame of the yard waste support system.

* * * * *